US007052126B2

(12) United States Patent
Suzuki et al.

(10) Patent No.: US 7,052,126 B2
(45) Date of Patent: May 30, 2006

(54) INKJET RECORDING APPARATUS

(75) Inventors: Keiichiro Suzuki, Hachioji (JP); Takayuki Kato, Hachioji (JP); Taku Mitsuhashi, Hachioji (JP)

(73) Assignee: Konica Minolta Holdings, Inc., Tokyo (JP)

( * ) Notice: Subject to any disclaimer, the term of this patent is extended or adjusted under 35 U.S.C. 154(b) by 0 days.

(21) Appl. No.: 10/942,157

(22) Filed: Sep. 15, 2004

(65) Prior Publication Data

US 2005/0068399 A1 Mar. 31, 2005

(30) Foreign Application Priority Data

Sep. 25, 2003 (JP) ..... 2003-333207

(51) Int. Cl.
*B65H 29/00* (2006.01)

(52) U.S. Cl. ..... 347/104; 271/193; 226/94

(58) Field of Classification Search ..... 347/104; 271/193; 226/94
See application file for complete search history.

(56) References Cited

U.S. PATENT DOCUMENTS 3,448,979 A * 6/1969 Farmer ..... 271/33
4,244,465 A * 1/1981 Hishikawa et al. ..... 198/691
4,856,769 A * 8/1989 Andrew et al. ..... 271/193
5,225,852 A 7/1993 Uchida et al.
5,345,863 A * 9/1994 Kurata et al. ..... 101/126
5,531,436 A 7/1996 Ohyama et al.
5,854,643 A 12/1998 Katsuyama
6,309,064 B1 * 10/2001 Tanno et al. ..... 347/104
6,511,152 B1 1/2003 Yoshimura
6,622,623 B1 * 9/2003 Helmstadter ..... 101/232
6,652,938 B1 * 11/2003 Nishikawa et al. ..... 428/35.9

FOREIGN PATENT DOCUMENTS

JP 07-137877 A 5/1995
JP 2001-277656 A 10/2001

* cited by examiner

*Primary Examiner*—Andrew H. Hirshfeld
*Assistant Examiner*—Jill E. Culler
(74) *Attorney, Agent, or Firm*—Frishauf, Holtz, Goodman & Chick, P.C.

(57) ABSTRACT

An inkjet recording apparatus for providing a high-quality image wherein a recording medium is thoroughly sucked by a conveyance belt and is accurately conveyed, thereby saving much time and effort. A conveyance belt 7 for supporting and conveying a recording medium 4 is provided, and an electrostatic generator 10 is installed to generate electrostatic force for sucking the recording medium 4 and to supply electrostatic force to the conveyance belt 7, wherein the conveyance belt 7 is designed in such a way that at least the recording medium contact surface is adhesive.

8 Claims, 2 Drawing Sheets

INKJET RECORDING APPARATUS

BACKGROUND OF THE INVENTION

1. Field of the Invention

The present invention relates to an inkjet recording apparatus, particularly to an inkjet recording apparatus wherein a fabric of low rigidity that creases easily is used as a main recording medium, the inkjet recording apparatus comprising a conveyance belt.

2. Description of Related Art

In recent years, a wave of digitization is sweeping the field of images. Especially the textile printing industry is paying attention to the inkjet recording apparatus, rather than the prior art screen textile printing, because the inkjet recording apparatus meets requirements for quick response, small lots and a low volume production of a wide variety of products. Similarly, the field of sign display places expectations on the inkjet recording apparatus capable of forming an image in a simpler and less costly manner than the conventional screen printing or gravure printing.

The textile printing industry uses a fabric of low rigidity as a main recording medium, and the material woven of plastics (polyvinyl chloride), in addition to paper is utilized in the sign display industry. When such a material of low rigidity is used as a recording medium, the recording medium is conveyed generally in close contact with the conveyance belt.

The inkjet recording apparatus where the recording medium is conveyed in close contact with the conveyance belt includes the commonly known inkjet recording apparatus, wherein an adhesive layer using such an upholstering agent as water soluble resin, pressure sensitive resin and heat sensitive resin, and adhesive sheet is formed on the surface of the conveyance belt, and the recording medium is conveyed in close contact with this adhesive layer (See Patent Document 1, for example).

In the inkjet recording apparatus where paper as a recording medium is conveyed by a conveyance belt to record an image, on the other hand, there is a known inkjet recording apparatus. This inkjet recording apparatus has an electrostatic generator arranged on the bottom of the conveyance belt to charge the conveyance belt and to suck a recording medium electrostatically (See Patent Document 2, for example). This inkjet recording apparatus uses an electrostatic generator to charge the conveyance belt electrostatically, and paper is supported by the charged belt, whereby paper is sucked by the conveyor by contact charging.

[Patent Document 1] Official Gazette of Japanese Patent Tokkai 2001-277656

[Patent Document 2] Official Gazette of Japanese Patent Tokkaihei 7-137877

In the inkjet recording apparatus (Patent Document 1) having a conveyance belt provided with a prior art adhesive layer, irregularities are produced on the surface due to repeated adhesion and separation of the recording medium from the conveyance belt; hence, the adhesive strength is reduced by the deposition of dust and contaminants. Thus, the adhesive must be removed for washing at least once in a few months, and adhesive must be applied again. This has taken much time and effort, according to the prior art.

Further, in the aforementioned conventional inkjet recording apparatus, the recording medium is brought in close contact with the conveyance belt by the adhesive layer alone, and the adhesive layer has a high degree of adhesive strength. Once the recording medium is adhered to the conveyance belt, the displacement of the recording medium cannot be corrected, with the result that adhesion and separation are repeated, and much time and effort are required, according to the prior art.

In the inkjet recording apparatus (Patent Document 2) equipped with a conventional electrostatic generator, even when the recording medium impervious to electric charging, including such a fabric such as cotton and silk fabrics or such a woven fabric polyvinyl chloride fabric, is supported by a conveyance belt charged by an electrostatic generator, the recording medium is not sucked by the conveyance belt, so that the recording medium slips on the conveyance belt and accurate conveyance cannot be achieved. This has resulted in production of a defective image, according to this prior art.

The aforementioned prior art inkjet recording apparatus is subject to such a restriction that the conveyance belt is made of the polycarbonate or polyethylene that is susceptible to electrostatic charge.

Further, in the conventional inkjet recording apparatus, the principle of electrostatic suction is based on Coulomb force, and electrostatic suction force is damped by the function of the distance between the conveyance belt and recording medium. Accordingly, the conveyance belt has a thickness of about 0.1 through 0.2 mm. However, if the thickness is small, the durability of the conveyance belt is reduced so that the conveyance belt must be replaced frequently. This has required much time and effort.

To ensure durability of the conveyance belt to a certain extent and to provide accurate transfer of a recording medium, it is possible to consider a method of applying a high voltage to the electrode constituting the electrostatic generator, thereby increasing the electrostatic force. If the applied voltage is increased, however, deflection occurs to ink particles discharged from the recording head to the recording medium, with the result that the position of ink particles hitting the recording medium may deviate.

SUMMARY

In view of the prior art described above, it is an object of the present invention to provide an inkjet recording apparatus capable of completely sucking the recording medium onto the conveyance belt and ensuring accurate conveyance without requiring much time and effort.

To achieve the aforementioned object, the inkjet recording apparatus of the present invention comprises a conveyance belt for supporting and transporting a recording medium, and an electrostatic generator for generating electrostatic suction force to suck the aforementioned recording medium, wherein at least the recording medium contacting surface of the conveyance belt in contact with the recording medium is adhesive.

The aforementioned object can be achieved by the embodiments described below:

(1) A recording medium is held in close contact with a conveyance belt electrostatically charged by an electrostatic generator, through the adhesion of the recording medium contact surface of the conveyance belt. Because of this arrangement, even a recording medium impervious to electric charging is sucked by the conveyance belt by the polarization of electric charge. Where, "the recording medium contact surface of the conveyance belt" means that a surface of the conveyance belt, which is in contact with a recording medium.

Since a recording medium is subjected to electrostatic suction, the adhesion of the recording medium contact surface can be kept to such a level that the recording medium is held in close contact with the conveyance belt, without causing the recording medium to be creased.

It is sufficient only if the recording medium can be polarized, without the need of reducing the thickness of the conveyance belt. This arrangement allows the conveyance belt to have a certain thickness.

(2) In an inkjet recording apparatus described in (1), the aforementioned electrostatic suction does not exceed 0.7 N/100 $cm^2$, and the aforementioned adhesion is 0.02 N/25 mm or more without exceeding 1 N/25 mm.

According to the invention described in (2), the adhesion of recording medium contact surface of the conveyance belt is 0.02 N/25 mm or more. Thus, the recording medium is thoroughly sucked by the conveyance belt charged by the electrostatic generator, and the recording medium is sucked sufficiently by the conveyance belt through polarization of the electric charge of the recording medium.

Further, adhesion does not exceed 1 N/25 mm; therefore, easy correction of the displacement of the recording medium is provided by suspending the generation of electrostatic force, without the need of separating the recording medium kept in close contact with the conveyance belt 7 or bringing it again in contact.

Since the electrostatic force does not exceed 0.7 N/100 $cm^2$, the ink particle discharged to the recording medium does not deflect, even if inkjet recording method is utilized.

(3) In the inkjet recording apparatus described in (1) or (2), the recording medium contact surface of the aforementioned conveyance belt is designed in a flat form.

According to the invention described in (3), the recording medium contact surface of the aforementioned conveyance belt is designed in a flat form, without allowing the recording medium to become loose. This arrangement ensures that the recording medium is firmly kept in contact with the conveyance belt charged by the electrostatic generator, and the recording medium is sucked sufficiently by the conveyance belt through polarization of the electric charge of the recording medium.

(4) In the inkjet recording apparatus described in any one of the aforementioned (1) through (3), the aforementioned conveyance belt is characterized in that at least the recording medium contact surface is made of a silicone rubber.

According to the invention described in (4), the recording medium contact surface is made of a silicone rubber and has a predetermined adhesion. This arrangement ensures that the recording medium is firmly kept in contact with the conveyance belt charged by the electrostatic generator, and the recording medium is sucked sufficiently by the conveyance belt through polarization of the electric charge of the recording medium. Further, easy correction of the displacement of the recording medium is provided by suspending the generation of electrostatic force.

(5) In the inkjet recording apparatus described in any one of the aforementioned (1) through (3), the aforementioned conveyance belt is characterized in that at least the recording medium contact surface is made of an urethane based resin.

According to the invention described in (5), the recording medium contact surface is made of a urethane based resin, and has a predetermined adhesion. This arrangement ensures that the recording medium is firmly kept in contact with the conveyance belt charged by the electrostatic generator, and the recording medium is sucked sufficiently by the conveyance belt through polarization of the electric charge of the recording medium. Further, easy correction of the displacement of the recording medium is provided by suspending the generation of electrostatic force.

(6) In the inkjet recording apparatus described in any one of the aforementioned (1) through (5), the conveyance belt is formed by lamination and the volume resistivity of at least one layer is equal to or greater than $10^3 \Omega$ cm.

According to the invention described in (6), electrostatic force generated on the conveyance belt by the electrostatic generator is maintained, and the recording medium kept in close contact with the conveyance belt by the adhesion of the recording medium contact surface is thoroughly sucked by the conveyance belt through polarization of electric charge.

(7) In the inkjet recording apparatus described in any one of the aforementioned (1) through (6), the aforementioned recording medium is made of fabric.

According to the invention described in (7), the fabric is kept in close contact with the conveyance belt by the adhesion of the recording medium contact surface; therefore, the recording medium is thoroughly sucked by the conveyance belt through polarization of electric charge, even if fabric impervious to electric charging is utilized. What is called the fabric is defined as the entire woven fabric, including such chemical fibers as polyvinyl chloride or polyester.

Since the fabric is subjected to electrostatic suction, the adhesion of the recording medium contact surface can be kept to such a level that the fabric is held in close contact with the conveyance belt, without causing the fabric to be creased.

According to the invention described in (1), the recording medium contact surface of the conveyance belt has a predetermined adhesion, and the recording medium is kept in close contact with the conveyance belt charged by the electrostatic generator. The recording medium is sucked by the conveyance belt through polarization of electric charge, even if fabric impervious to electric charging is utilized. This arrangement ensures accurate conveyance of the recording medium, hence provides a satisfactory image.

Further, it is sufficient only if the recording medium can be polarized. This arrangement allows the conveyance belt to have a certain thickness, and ensures excellent durability of the conveyance belt, reduced frequency of conveyance belt replacement and minimized time and effort for conveyance belt replacement.

Further, the adhesion of the recording medium contact surface can be kept to such a level that the recording medium is held in close contact with the conveyance belt, without causing the recording medium to be creased. This configuration ensures easy correction of the displacement of the recording medium, and hence saves the time and effort of separating the recording medium in close contact with the conveyance belt and bringing it in contact again.

According to the invention described in (2), the adhesion of recording medium contact surface of the conveyance belt is 0.02 N/25 mm or more. Thus, the recording medium is thoroughly sucked by the conveyance belt charged by the electrostatic generator, and the recording medium is sucked sufficiently by the conveyance belt through polarization of the electric charge of the recording medium. This arrangement ensures accurate conveyance of the recording medium, hence provides a satisfactory image.

Further, adhesion does not exceed 1 N/25 mm. This permits easy correction of the displacement of the recording medium, and hence saves the time and effort of separating the recording medium in close contact with the conveyance belt and bringing it in contact again.

Since the electrostatic force does not exceed 0.7 N/100 $cm^2$ and the ink particle discharged does not deflect, ink hits a predetermined position on the recording medium to provide a satisfactory image.

According to the invention described in (3), the recording medium contact surface of the aforementioned conveyance belt is designed in a flat form, without allowing the recording medium to become loose. This arrangement ensures that the recording medium is firmly kept in contact with the conveyance belt charged by the electrostatic generator, and the recording medium is sucked sufficiently by the conveyance belt through polarization of the electric charge of the recording medium, with the result that accurate conveyance of the recording medium, and hence a satisfactory image are provided.

According to the invention described in (4), the recording medium contact surface is made of a silicone rubber and has a predetermined adhesion. This arrangement ensures that the recording medium is firmly kept in contact with the conveyance belt charged by the electrostatic generator, and the recording medium is sucked sufficiently by the conveyance belt through polarization of the electric charge of the recording medium, with the result that accurate conveyance of the recording medium, and hence a satisfactory image are provided.

Further, it is sufficient only if the recording medium can be polarized. This arrangement allows the conveyance belt to have a certain thickness, and ensures excellent durability of the conveyance belt, reduced frequency of conveyance belt replacement and minimized time and effort for conveyance belt replacement.

Further, the adhesion of the recording medium contact surface can be kept to such a level that the recording medium is held in close contact with the conveyance belt, without causing the recording medium to be creased. This configuration ensures easy correction of the displacement of the recording medium, and hence saves the time and effort.

According to the invention described in (5), the recording medium contact surface is made of a urethane based resin, and has a predetermined adhesion. This arrangement ensures that the recording medium is firmly kept in contact with the conveyance belt charged by the electrostatic generator, and the recording medium is sucked sufficiently by the conveyance belt through polarization of the electric charge of the recording medium, with the result that accurate conveyance of the recording medium, and hence a satisfactory image are provided.

Further, it is sufficient only if the recording medium can be polarized. This arrangement allows the conveyance belt to have a certain thickness, and ensures excellent durability of the conveyance belt, reduced frequency of conveyance belt replacement and minimized time and effort for conveyance belt replacement.

Further, the adhesion of the recording medium contact surface can be kept to such a level that the recording medium is held in close contact with the conveyance belt, without causing the recording medium to be creased. This configuration ensures easy correction of the displacement of the recording medium, and hence saves the time and effort.

According to the invention described in (6), electrostatic force generated on the conveyance belt by the electrostatic generator is maintained, and the recording medium kept in close contact with the conveyance belt by the adhesion of the recording medium contact surface is thoroughly sucked by the conveyance belt through polarization of electric charge, with the result that accurate conveyance of the recording medium, and hence a satisfactory image are provided.

According to the invention described in (7), the recording medium contact surface has a predetermined adhesion, and the fabric is kept in close contact with the conveyance belt by the adhesion of the recording medium contact surface; therefore, the fabric is thoroughly sucked by the conveyance belt through polarization of electric charge, even if fabric impervious to electric charging is utilized, with the result that accurate conveyance of the fabric, and hence a satisfactory image are provided.

Further, it is sufficient only if the fabric can be polarized. This arrangement allows the conveyance belt to have a certain thickness, and ensures excellent durability of the conveyance belt, reduced frequency of conveyance belt replacement and minimized time and effort for conveyance belt replacement.

Further, the adhesion of the recording medium contact surface can be kept to such a level that the recording medium is held in close contact with the conveyance belt, without causing the recording medium to be creased. This configuration ensures easy correction of the displacement of the recording medium, and hence saves the time and effort of separating the recording medium in close contact with the conveyance belt and bringing it in contact again.

DETAILED DESCRIPTION OF THE EMBODIMENT

Figure 1:
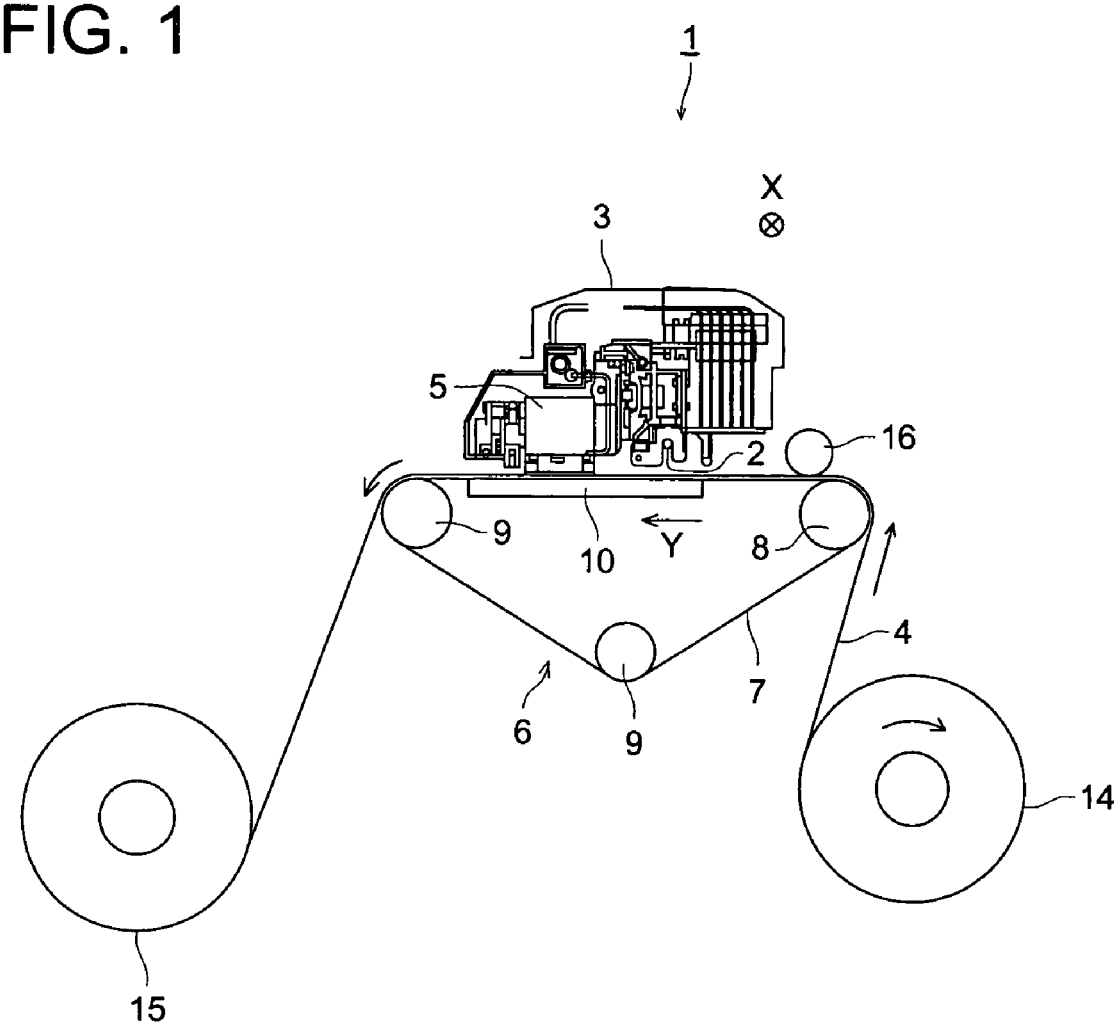
FIG. 1 is a drawing representing the configuration of an inkjet recording apparatus as an embodiment of the present invention.
Figure 2:
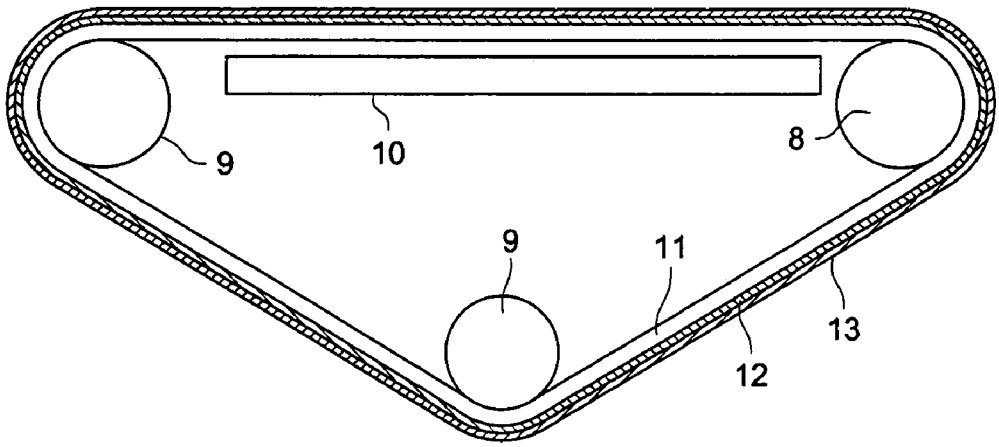
FIG. 2 is a drawing representing the configuration of a conveyance belt of the present embodiment.

The following describes the embodiment of the present invention with reference to FIGS. 1 and 2:

FIG. 1 is a drawing representing an inkjet printer 1 of the inkjet recording apparatus as an embodiment of the present invention. This inkjet printer 1 is a serial head type inkjet printer 1.

The inkjet printer 1 has a rod-shaped guide rail 2, as shown in FIG. 1 and a carriage 3 is supported by the guide rail 2. The carriage 3 performs a reciprocating motion in the main scanning direction X along the guide rail 2 by means of a carriage drive mechanism (not illustrated).

The carriage 3 is equipped with a recording head 5 having a nozzle (not illustrated) that discharges the ink of each of yellow (Y), magenta (M) cyan (C) and black (K) to a recording medium 4.

It is possible to apply the recording medium 4 woven from fabric or plastic material (polyvinyl chloride) because of low rigidity and easy formation of creases. Especially the recording medium 4 impervious to electric charging can be utilized.

The central portion of the movable range of the carriage 3 is assumed as a recording area for recording on the recording medium 4. This recording area contains a conveyance section 6 for conveying the recording medium 4 in the direction Y orthogonal to the widthwise direction. In this conveyance section 6, an annular conveyance belt 7 for supporting the recording medium 4 on a flat plane and moving it in the horizontal direction is tightened by a drive roller 8 for rotating the conveyance belt 7, and a tension roller 9, driven by the drive roller 8, for applying tension to the conveyance belt 7. The conveyance section 6 repeats conveyance and stop of the recording medium 4 in conformity to the operation of the carriage 3 at the time of recording an image so that the recording medium 4 is conveyed intermittently.

An electrostatic generator 10 is arranged below the recording medium supporting surface for supporting the recording medium 4 on a flat plane, wherein the electrostatic generator 10 generates electrostatic force for sucking the recording medium 4 and supplies electrostatic force to the conveyance belt 7. This electrostatic generator 10 has a plurality of thermocouples (not illustrated) where cathodes and anodes are alternately arranged in a comb-toothed form. The conveyance belt 7 is electrically changed by applying d.c. voltage to this thermocouple.

Table 1 shows the relationship between the electrostatic suction force and the presence/absence of the deflection in ink particles discharged to the recording medium 4 from the recording head 5. Table 1 has been formed according to the following procedure: A deflection evaluation chart was created by repeatedly recording one-dot lines on a 119 cm-wide sample, leaving a one-dot space. If image irregularities were found by visual observation, the ink particles were considered to be deflected. If no image irregularities were found, the ink particles were evaluated as being free from deflection. A mark "B" is given when there is no deviation of ink particles, and "D" is assigned if there is a deviation. It can be seen from Table 1 that, if the electrostatic suction does not exceed 0.7 N/100 $cm^2$, deflection of ink particles does not occur.

TABLE 1

| | Electrostatic suction (N/100 $cm^2$ (for PET)) | | | | | |
|---|---|---|---|---|---|---|
| | 0.5 | 0.6 | 0.7 | 0.8 | 0.9 | 1.0 |
| Ink particles deflected or not | B | B | B | D | D | D |

Thus, for the purpose of avoiding deflection of the ink particles coming out of the recording head 5, the electrostatic generator 10 applies d.c. voltage to the electrode couple so that the electrostatic suction will not exceed 0.7 N/100 $cm^2$.

As shown in FIG. 2, the conveyance belt 7 has a substrate 11. An electrostatic force holding layer 12 capable of holding electrostatic force is provided on the outer surface of this substrate 11. The substrate 11 indludes glass cloth, for example. The electrostatic force holding layer 12 is preferred to be made of Teflon (polytetrafluoroethylene: registered trademark), for example, to ensure that the conveyance belt 7 holds the electrostatic force to provide satisfactory suction of the recording medium 4. Further, an adhesive layer 13 is arranged on the surface of the electrostatic force holding layer 12, where the adhesive layer 13 includes silicone- or urethane-based resin and has a flat surface. This arrangement provides adhesion to the surface of the conveyance belt 7 which is in contact with the recording medium 4.

Table 2 shows the relationship between the adhesion and looseness of the fabric. Table 2 has been created according to the following procedure: A weight roller was rolled on a 140 cm×50 cm fabric placed on the conveyance belt to apply a surface pressure of 20 g/$cm^3$. Then evaluation was made by visual observation to see if the fabric was loosened or not. A mark "B" was given if it was not loosened, and "D" was given if it was loosened. The adhesion is based on the 90-degrees Celsius peeling test conforming to the JIS (the Japanese Industrial Standards) Z0237. Table 2 shows that fabric is not loose if the adhesion is 0.02 N/25 mm or more.

TABLE 2

| | Electrostatic suction (N/25 $mm^2$ (for PET)) | | | | |
|---|---|---|---|---|---|
| | 0.03 | 0.02 | 0.01 | 0.005 | 0.003 |
| Fabric loose or not | B | B | D | D | D |

Thus, in order to prevent the recording medium 4 from becoming loose on the conveyance belt 7 and to keep the recording medium 4 in close contact with the conveyance belt 7, the adhesive layer 13 is formed in such a way that the adhesion is 0.02 N/25 mm or more.

The adhesive layer has a flat surface. Being "flat" in this case refers to such a level of flatness that the recording medium 4 can be prevented from becoming loose, by the irregularities on the surface, and the recording medium and conveyance belt can be kept in close contact with each other, to the extent of allowing polarization of the electric charge of the recording medium.

Table 3 shows the relationship between adhesion and the possibility of horizontal movement. Table 3 has been created according to the following procedure: A weight roller was rolled on a 140 cm×50 cm fabric placed on the conveyance belt to apply surface pressure of 20 g/$cm^2$. One side of 140 cm was moved in the horizontal direction. In this case, measurement was made by visual observation to check whether or not it could be moved without a crease or looseness occurring to the fabric. The result of this measurement was summarized in Table 3. A mark "B" was given when horizontal movement was made without a crease occurring to the fabric, while "D" was given when this movement failed. The adhesion is based on the 90-degree Celsius peeling test conforming to the JIS (the Japanese Industrial Standards) Z0237. Table 3 shows that horizontal movement without crease is possible if the adhesion does not exceed 1.0 N/25 mm.

TABLE 3

| | Electrostatic suction (N/25 $mm^2$ (for PET)) | | | | | |
|---|---|---|---|---|---|---|
| | 0.8 | 0.9 | 1.0 | 1.1 | 1.2 | 1.3 |
| Horizontal movement or not | B | B | B | D | D | D |

Thus, the adhesive layer 13 is configured to have an adhesion not exceeding 1 N/25 mm to ensure that the position of the recording medium 4 can be adjusted by sliding it on the conveyance belt 7 without the need of separating the recording medium 4 kept in close contact with the conveyance belt 7 or bringing it again in contact.

As shown in FIG. 1, the inkjet printer 1 has a feedout roller 14 for feeding a long-scale recording medium 4 to the conveyance section 6, and a winding roller 15 for winding up the recording medium 4 with an image recorded thereon. The feedout roller 14 and winding roller 15 are designed to feed out and wind the recording medium 4, respectively in conformity to the image recording operation by a roller drive mechanism (not illustrated).

A conveyance roller 16 for conveying the recording medium 4 in the direction of its conveyance Y together with the conveyance belt 7 is located between the feedout roller 14 and winding roller 15, upstream from the recording medium contact surface of the conveyance belt 7.

The following describes the operation of the present embodiment:

When recording the image the conveyance section 6 and roller drive mechanism are driven, and the recording medium 4 is fed downward of the recording head 5. When the recording medium 4 has reached a predetermined position downward of the recording head 5, the carriage drive mechanism actuates to cause the carriage 3 to make a reciprocating motion over the recording medium 4. Then a predetermined amount of ink particle is discharged sequentially from the recording head 5 based on the image information, and are hardened after having hit the recording medium 4, whereby an image is recorded.

On the recording medium supporting surface of the conveyance belt 7, a predetermined d.c. voltage is applied to the electrode couple constituting the electrostatic generator 10, whereby the electrostatic force holding layer 12 is electrostatically charged and electrostatic force is maintained. Further, the adhesive layer 13 of a flat surface having an adhesion of 0.02 N/25 mm or more is formed on the recording medium contact surface. Thus, the recording medium 4 is thoroughly kept in close contact with the conveyance belt 7, with the result that the recording medium 4 is sufficiently sucked by the conveyance belt 7 through polarization of the electric charge of the recording medium 4.

It is sufficient only if the recording medium 4 can be polarized, without the need of reducing the thickness of the conveyance belt 7. This arrangement allows the conveyance belt 7 to have a certain thickness.

Further, adhesion does not exceed 1 N/25 mm; therefore, easy correction of the displacement of the recording medium 4 is provided by suspending the generation of electrostatic force, without the need of separating the recording medium 4 kept in close contact with the conveyance belt 7 or bringing it again in contact.

Since the electrostatic force does not exceed 0.7 N/25 mm, the ink particle discharged from the recording head 5 to the recording medium 4 does not deflect.

As described above, according to the present embodiment, the adhesive layer 13 of a flat surface having a predetermined adhesion is formed on the recording medium contact surface of the conveyance belt 7. Thus, the recording medium 4 is thoroughly kept in close contact with the conveyance belt 7, and the recording medium 4 is sufficiently sucked through polarization of the electric discharge of the recording medium 4, with the result that accurate conveyance of the recording medium 4, and hence a satisfactory image are provided.

It is sufficient only if the recording medium 4 can be polarized. This arrangement allows the conveyance belt 7 to have a certain thickness, and ensures excellent durability of the conveyance belt 7, reduced frequency in the replacement of the conveyance belt 7 and minimized time and effort in the replacement of the conveyance belt 7.

Since easy correction of the displacement of the recording medium 4 is provided, the present embodiment saves the time and effort of separating the recording medium 4 kept in close contact with the conveyance belt 7 or bringing it again in contact.

Since the electrostatic force does not exceed 0.7 N/100 $cm^2$ and the ink particle does not deflect, ink hits a predetermined position on the recording medium 4 to provide a satisfactory image.

In the present embodiment, the conveyance belt 7 is equipped with the adhesive layer 13 formed of adhesive material on the outer surface. However, the substrate may be impregnated with adhesive material.

What is claimed is:

1. An inkjet recording apparatus, comprising:

a conveyor belt to transport a recording medium while holding the recording medium thereon and including an adhesive layer as a surface layer of the conveyance belt to be in contact with the recording medium, and an electrostatic generator to generate electrostatic suction force to suck the recording media onto the adhesive layer of the conveyor belt, wherein the electrostatic suction force is 0.7 N/100 $cm^2$ or less.

2. The inkjet recording apparatus of claim 1, wherein the adhesion force of the adhesive layer is 0.02 N/25 mm or more.

3. The inkjet recording apparatus of claim 1, wherein the surface layer of the conveyance belt being in contact with the recording medium is substantially flat.

4. The inkjet recording apparatus of claim 1, wherein the adhesive layer is formed by silicone based resin.

5. The inkjet recording apparatus of claim 1, wherein the adhesive layer is formed by urethane based resin.

6. The inkjet recording apparatus of claim 1, wherein the conveyance belt comprises lamination layers and one layer of the lamination layers has a volume resistivity of 1000 ohms cm or less.

7. The inkjet recording apparatus of claim 6, wherein the lamination layers comprise a substrate, an electrostatic force holding layer and the adhesive layer, the electrostatic force holding layer and the adhesive layer are provided on the substrate in this order.

8. The inkjet recording apparatus of claim 1, wherein the recording medium is a fabric.

* * * * *